US005394119A

United States Patent [19]

Pleva et al.

[11] Patent Number: 5,394,119

[45] Date of Patent: Feb. 28, 1995

[54] RADIO FREQUENCY CONNECTOR FOR A PATCH COUPLED APERTURE ARRAY ANTENNA

[75] Inventors: Joseph S. Pleva, Londonderry, N.H.; Conant: James B., Brighton; Norbert Sa, Burlington, both of Mass.; Steven A. Upson, Amherst, N.H.; Joseph Simoneau, Tyngsboro; Eugene Gelshteyn, Marblehead, both of Mass.

[73] Assignee: Raytheon Company, Lexington, Mass.

[21] Appl. No.: 111,089

[22] Filed: Aug. 24, 1993

[51] Int. Cl.[6] ..... H01P 5/08

[52] U.S. Cl. ..... 333/35; 333/260; 343/906

[58] Field of Search ..... 333/24 C, 33, 35, 260; 439/581, 582; 343/906

[56] References Cited

U.S. PATENT DOCUMENTS

| | | | |
|---|---|---|---|
| 4,283,694 | 8/1981 | Pauker | 333/35 X |
| 4,631,505 | 12/1986 | Schiavone | 333/33 |
| 4,995,815 | 2/1991 | Buchanan et al. | 333/33 X |
| 5,073,761 | 12/1991 | Waterman et al. | 333/24 C |

FOREIGN PATENT DOCUMENTS

| | | | |
|---|---|---|---|
| 70601 | 4/1983 | Japan | 333/260 |
| 101 | 1/1985 | Japan | 333/33 |

OTHER PUBLICATIONS

Microwave Engineering, Peter A. Rizzi, Library of Congress Cataloging-in-Publication Data, 1988 by Prentice-Hall, Inc., ISBN 0-13-586702-9, pp. 279-281.

*Primary Examiner*—Paul Gensler
*Attorney, Agent, or Firm*—Donald F. Mofford

[57] ABSTRACT

A radio frequency connector for a patch-coupled aperture array antenna is described including a coaxial connector having an outer shield and an inner conductive member with a dielectric material disposed between the outer shield and a portion of the inner conductive member and a dielectric substrate having a first and a second surface with an opening extending from the first surface of the dielectric substrate to the second surface of the dielectric substrate, the inner conductive member extending through at least a portion of the opening of the dielectric substrate. The radio frequency connector further includes a coupling conductive members having a protruding pin, the protruding pin connected to the inner conductive member and a sheet of dielectric material disposed juxtapositional with the dielectric substrate and covering the coupling conductive member. With such an arrangement, a less expensive radio frequency connector for an antenna is provided which can survive a high temperature environment.

11 Claims, 6 Drawing Sheets

RADIO FREQUENCY CONNECTOR FOR A PATCH COUPLED APERTURE ARRAY ANTENNA

BACKGROUND OF THE INVENTION

This invention relates to patch radiator antennas and more particularly to patch radiator antennas wherein multiple patch radiators are used to control the direction of a beam of radio frequency (RF) energy from the antenna.

In missile applications, antennas are often required to be mounted conformally with the generally cylindrical shape of a missile. Antennas which adapt easily to conformal mounting usually produce a beam of RF energy having a main lobe directed normally (or broadside to) the missile. In fuzing applications, the required direction of the main lobe of the beam of RF energy is in a direction forward of the missile. To provide the latter, known patch antennas either include elements which are parasitically fed or corporate feeds to provide the RF energy to each patch element.

In a missile application, it is desirable to reduce the size and the cost of components in the missile including the fuze antennas. A fuze antenna needs to be inexpensive and typically a direct fed patch is the least expensive to fabricate because the feed and patch can be etched on a single layer in one step. One disadvantage with a direct fed patch is feedline radiation which contributes to co-polarized pattern interference and high cross-polarization levels. To minimize feedline radiation, the spacing to the ground plane can be decreased, but decreasing the ground plane spacing decreases the bandwidth of the patch. A desired antenna requires greater bandwidth while minimizing feedline radiation.

In a corporate feed for a patch array antenna, it is typically necessary to use resistors at coupler isolation ports and feedline terminations. Typically, resistors are soldered or welded to the circuitry to provide the requisite connection. Unfortunately, in high temperature applications, solder is unsuitable and welding requires touch labor and more complicated fabrication adding to the cost of the antenna.

RF connectors must also be connected to the circuitry to provide an appropriate connection to the antenna. Typically, RF connectors are soldered or welded to the circuitry to provide the requisite connection, but in high temperature applications, as stated above, solder is unsuitable and welding requires touch labor and more complicated fabrication adding to the cost of the antenna.

SUMMARY OF THE INVENTION

With the foregoing background in mind, it is an object of this invention to provide a radio frequency connector having reduced fabrication cost but providing the requisite electrical and environmental parameters for a missile.

Another object of this invention is to provide a radio frequency connector adapted to connect coaxial cable to strip conductor circuitry in a stripline arrangement.

The foregoing and other objects of this inventions are met generally by a radio frequency connector including a coaxial connector having an outer shield and an inner conductive member with a dielectric material disposed between the outer shield and a portion of the inner conductive member and a dielectric substrate having a first and a second surface with an opening extending from the first surface of the dielectric substrate to the second surface of the dielectric substrate, the inner conductive member extending through at least a portion of the opening of the dielectric substrate. The radio frequency connector further includes a coupling conductive member having a protruding pin, the protruding pin connected to the inner conductive member and a sheet of dielectric material disposed juxtapositional with the dielectric substrate and covering the coupling conductive member. With such an arrangement, a radio frequency connector is provided which can easily be connected to a patch-coupled aperture array antenna fabricated in stripline to connect a coaxial cable to the patch-coupled aperture array antenna.

In accordance with another aspect of the present invention, an antenna includes a radio frequency transducer including a first and a second dielectric substrate, each dielectric substrate having a first and second surface and a first and a second sheet of conductive material, the first sheet of conductive material disposed on the first surface of the first dielectric substrate and the second sheet of conductive material disposed on the first surface of the second dielectric substrate. The radio frequency transducer further includes strip conductor circuitry disposed between the second surface of the first dielectric substrate and the second surface of the second dielectric substrate and a coaxial connector having an outer shield and an inner conductive member with a dielectric material disposed between the outer shield and a portion of the inner conductive member. The radio frequency transducer still further includes a dielectric substrate having a first and a second surface with an opening extending from the first surface of the dielectric substrate to the second surface of the dielectric substrate, the inner conductive member extending through at least a portion of the opening of the dielectric substrate and a strip of strip conductor having a protruding pin, the strip of strip conductor disposed diametrically opposed a portion of the strip conductor circuitry and the protruding pin mating with inner conductive member. Completing the radio frequency transducer is a sheet of dielectric material disposed between the portion of the strip conductor circuitry and the strip of strip conductor. With such an arrangement, a less expensive radio frequency transducer for an antenna is provided which can survive a high temperature environment.

BRIEF DESCRIPTION OF THE DRAWINGS

For a more complete understanding of this invention, reference is now made to the following description of the accompanying drawings, wherein.

DESCRIPTION OF THE PREFERRED EMBODIMENTS

Figure 1:
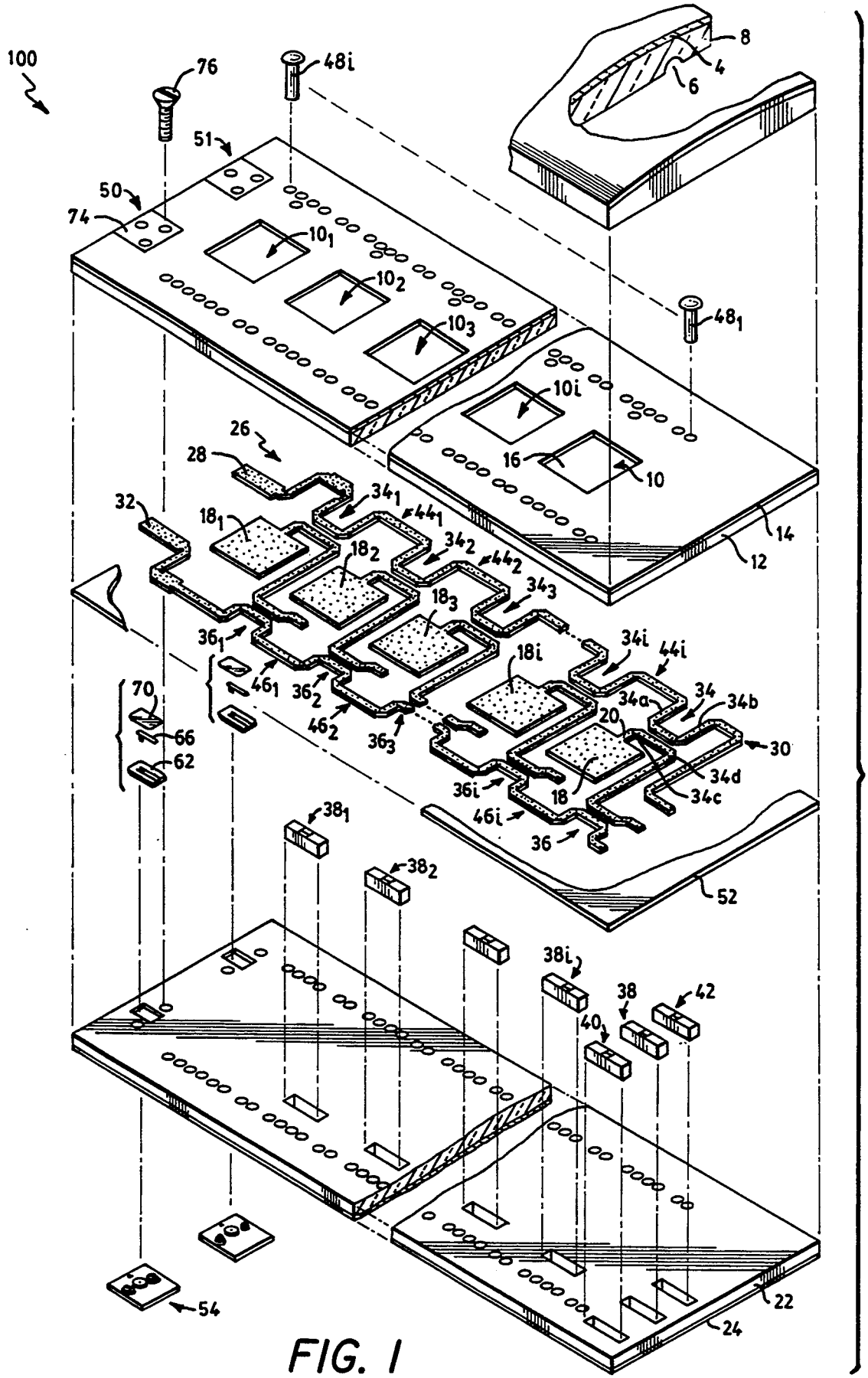
FIG. 1 is a sketch of an expanded isometric view of a patch-coupled aperture array antenna according to the invention.
Figure 5:
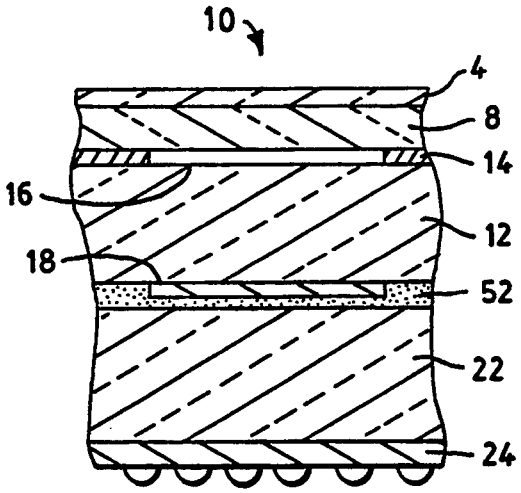
FIG. 5 is a cross-sectional view of one of the patch radiator elements according to the invention.

Referring now to FIG. 1, it may be seen that a patch-coupled aperture array antenna 100 as here contemplated is shown to include a plurality of patch radiator elements $\mathbf{10_1}$, $\mathbf{10_2}$, $\mathbf{10_3}$ . . . $\mathbf{10_i}$ and 10, here numbering 14 elements, exemplified by patch radiator element 10. Referring now also to FIG. 5, the patch radiator element 10 includes an upper dielectric substrate 12 having an upper and a lower surface. The upper dielectric substrate 12 is here a Teflon-based material with 15% E-glass fibers, oriented at a 0, 90 degrees fill weave direction, known as Taconic TLY-3 having a dielectric constant of approximately 2.33 and provided by Taconics Plastics Inc. of Petersburg, N.Y. A ground plane 14 is formed by depositing an electrically conducting material (here copper) in any conventional manner on the top surface of the upper dielectric substrate 12. Here, one ounce copper is used having a thickness of 0.0014 inches. An aperture 16 is provided in the ground plane 14 as shown. The aperture 16 has a length here of approximately 0.514 wavelengths of the RF energy propagating therethrough and a width of approximately 0.565 wavelengths of the RF energy propagating therethrough. A patch radiator 18 is disposed on the lower surface of the upper dielectric substrate 12 in alignment (i.e. having centers diametrically opposed) with the aperture 16 provided in the ground plane 14. A feedline 20 (also referred to as a strip conductor or a strip transmission line) is also disposed on the lower surface of the upper dielectric substrate 12 and connected to the patch radiator 18 to couple RF energy to the patch radiator 18. It should be appreciated that a patch radiator has a constant impedance along the width of the patch, but a changing impedance along the length of the patch. The location of a connection point along the length of the patch radiator 18 controls the resulting impedance of the connection point. Here the connection point is along the edge of the width of the patch radiator 18. The patch radiator 18 has a length here of approximately 0.416 wavelengths of the RF energy propagating therethrough and a width of approximately 0.545 wavelengths of the RF energy propagating therethrough. The feedline 20 has a width here of approximately 24 mils to provide a 100 ohm impedance stripline. The patch radiator 18 and the feedline 20 are etched during the same step from a one ounce copper sheet disposed on the dielectric substrate 12 in the fabrication process. It should be appreciated that each of the patch radiator elements are similar to the patch radiator 10 and disposed having similar dimensions.

The patch radiator element 10 further includes a lower dielectric substrate 22 having an upper and a lower surface. The lower dielectric substrate 22 is here also a Teflon-based material known as Taconic TLY-3. A ground plane 24 is formed by depositing an electrically conducting material (here copper) in any conventional manner on the lower surface of the lower dielectric substrate 22. Here, the copper has a thickness of 0,010 inches. The upper dielectric substrate 12 and the lower dielectric substrate 22 are provided from one-sixteenth inch boards having a sheet of copper disposed thereon which can be etched to remove the copper as needed. As described further hereinafter, to bond the upper dielectric substrate 12 with the lower dielectric substrate 22, a bonding layer 52 having a thickness of 0,005 mils is provided. With the upper dielectric substrate 12 with the ground plane 14 and the lower dielectric substrate 22 with the ground plane 24 bonded together with the bonding layer 52, a 130 mil stripline arrangement is provided. With a 24 mil wide strip conductor in between the upper dielectric substrate 12 and the lower dielectric substrate 22, a stripline having a 100 ohm impedance is provided.

Figure 2:
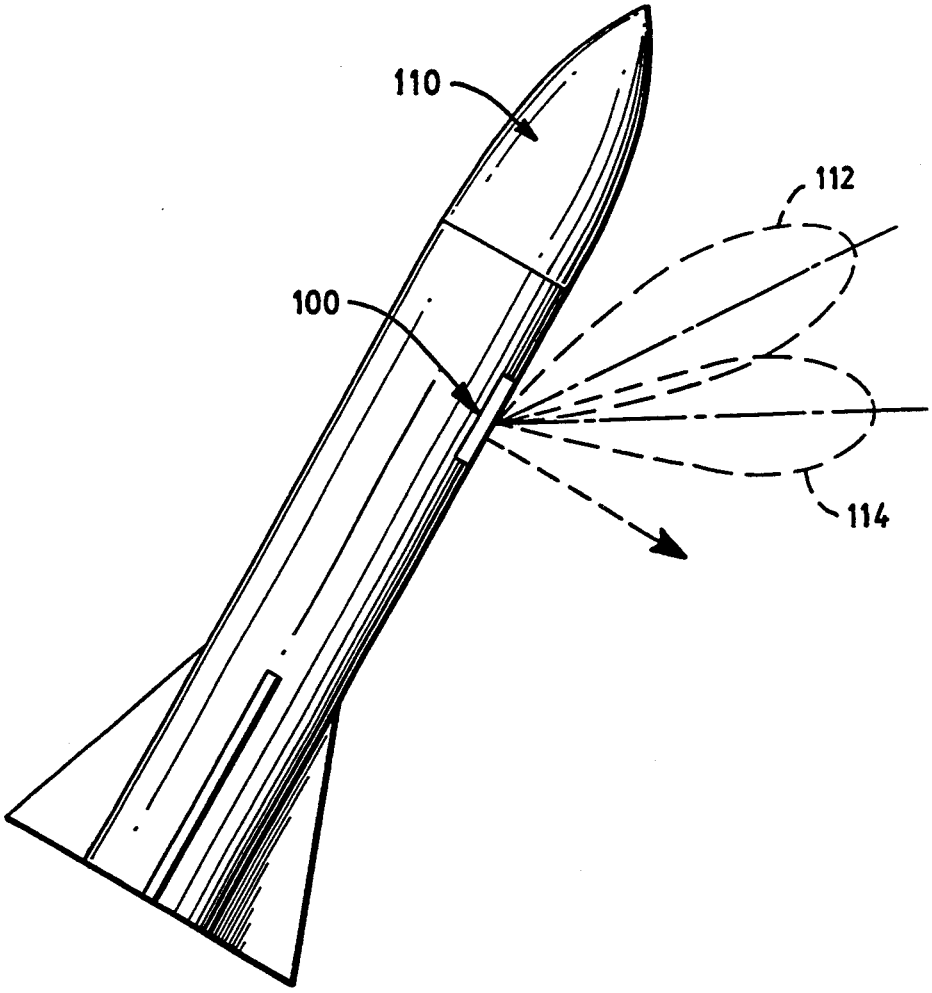
FIG. 2 is a view of the patch-coupled aperture array antenna according to the invention implemented in a missile.
Figure 3:
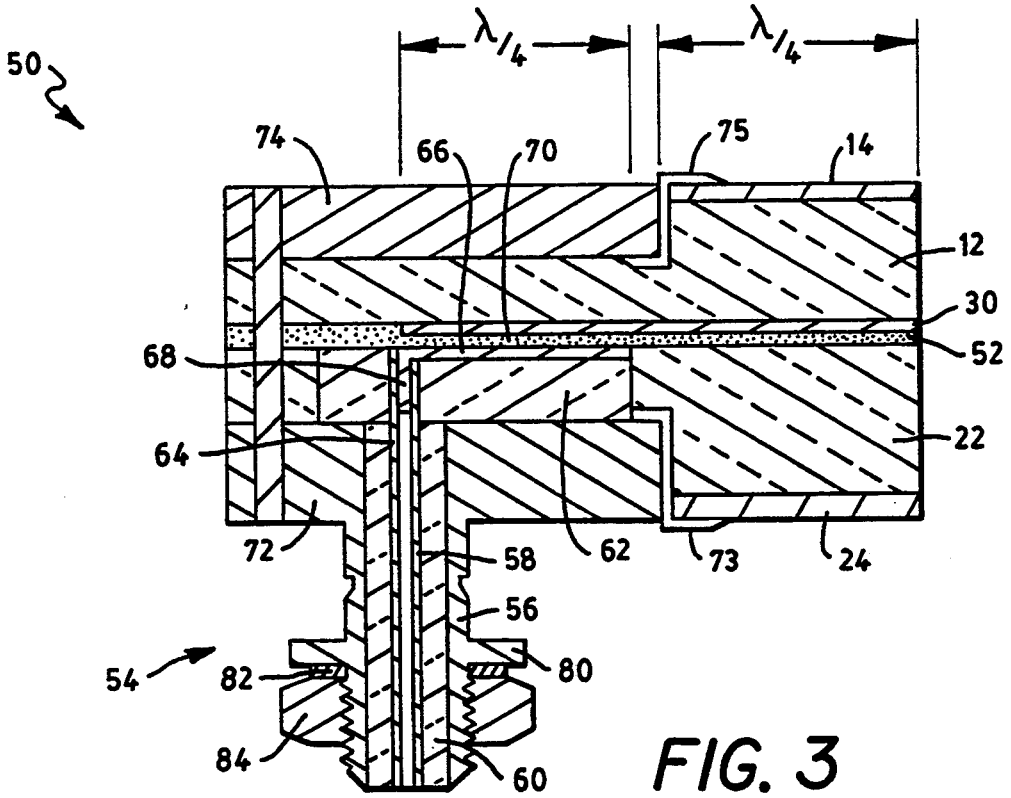
FIG. 3 is a cross-sectional view of the antenna showing an RF connector according to the invention.
Figure 3A:
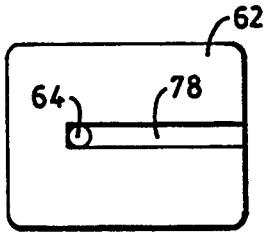
FIG. 3A is a plan view of a dielectric spacer.
Figure 3B:
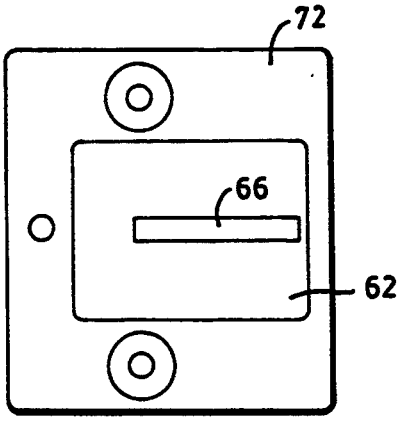
FIG. 3B is a plan view of the dielectric spacer and a conductive member within the RF connector according to the invention.
Figure 3C:
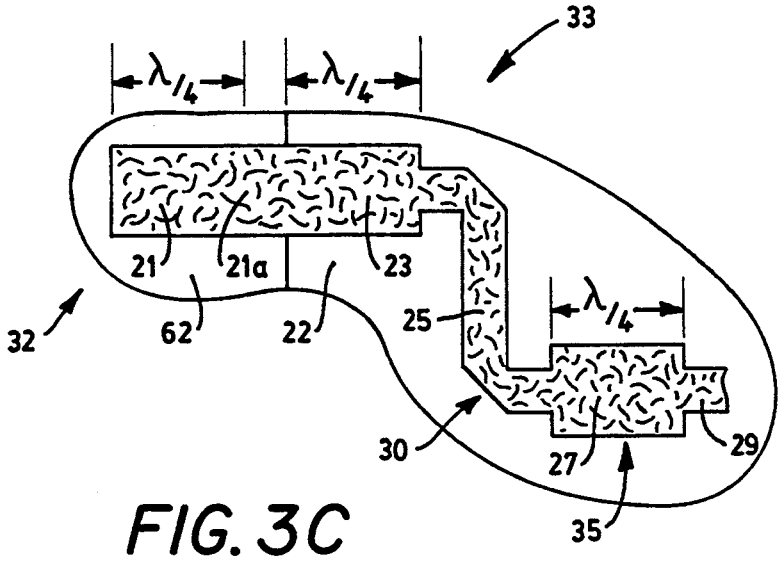
FIG. 3C is a plan view of a portion of strip conductor disposed within and about the RF connector according to the invention.

The patch-coupled aperture array antenna 100 can also include a spacer 8 here comprised of quartz having a dielectric constant of 3.8 and having a thickness of 0,090 inches. The quartz spacer 8 protects the patch-coupled aperture array antenna 100 from the environment and makes the patch-coupled aperture array antenna 100 conformal to the outer shell of the missile 110 (FIG. 2). The dielectric constant of the spacer 8 must be considered in the electrical tuning characteristics of the patch-coupled aperture array antenna 100. A channel 6 is provided in the quartz spacer 8, the channel 6 having a depth of 0.020±0,002 inches deep to accommodate the head of the rivets that provide mode suppression pins $\mathbf{48_1}$ . . . $\mathbf{48_i}$ as described further hereinafter. In the present embodiment, a polyamide resin 4 within a glass weave material having a thickness of 20 mils is wrapped around the outer surface of the missile and is disposed against the spacer 8.

Figure 1A:
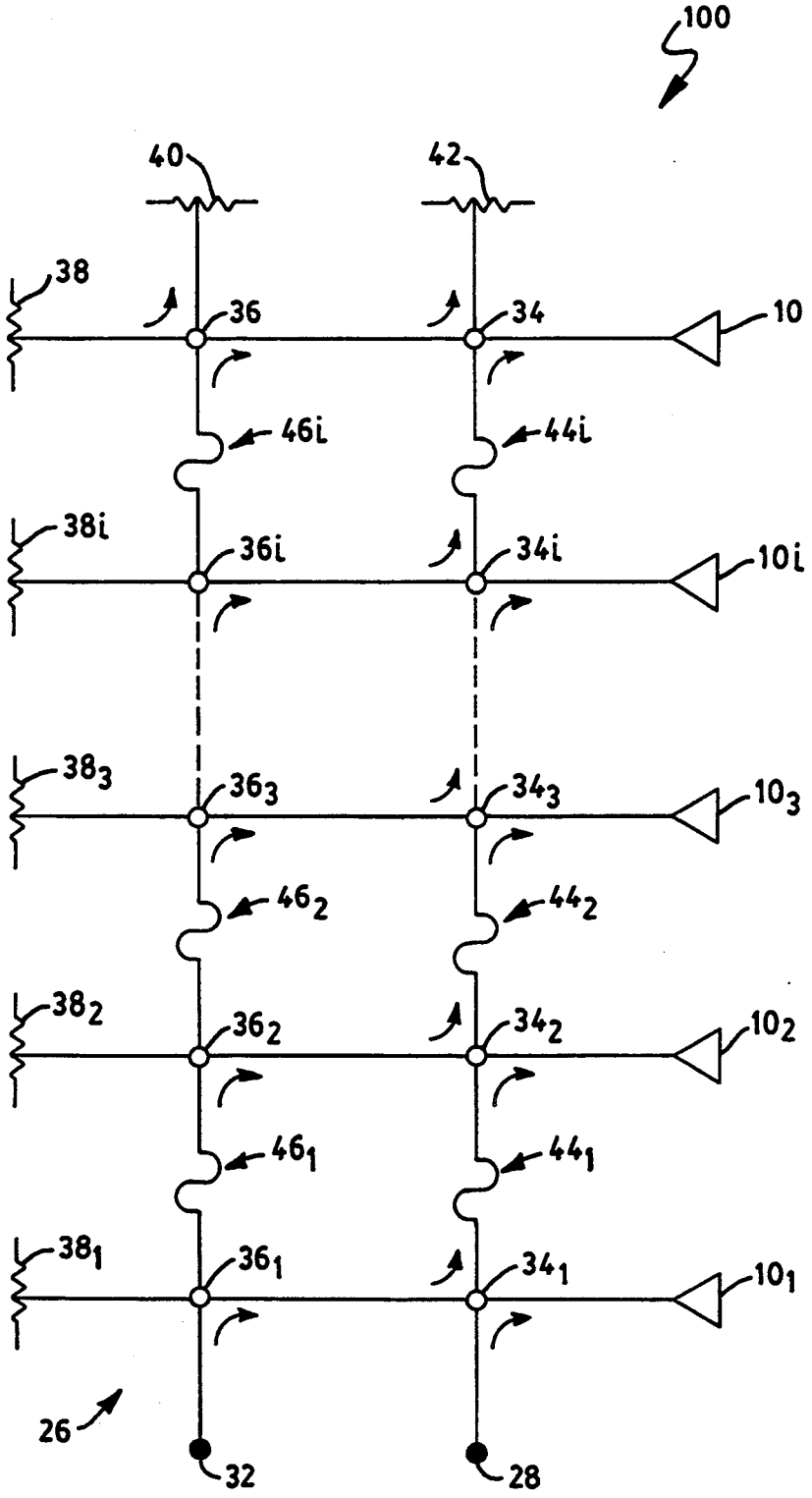
FIG. 1A is an electrical sketch of the patch-coupled aperture array antenna according to the invention.

The patch-coupled aperture array antenna 100 includes a feed network 26 .interconnected by strip conductor circuitry 30. Referring now also to FIG. 1A, the feed network 26 includes a feed point 28 and a feed point 32 wherein RF energy is coupled to the feed network 26. The feed network 26 is a modified version of what is commonly referred to as a Blass feed network to provide dual beam operation from a single array of patch radiators. The feed network 26 includes a plurality of couplers $\mathbf{34_1}$, $\mathbf{34_2}$, $\mathbf{34_3}$ . . . $\mathbf{34_i}$ and 34, $\mathbf{36_1}$, $\mathbf{36_2}$, $\mathbf{36_3}$ . . . $\mathbf{36_i}$ and 36, a plurality of terminating devices $\mathbf{38_i}$, $\mathbf{38_2}$, $\mathbf{38_3}$ . . . $\mathbf{38_i}$ and 38, 40 and 42 and a plurality of RF propagation networks $\mathbf{44_1}$, $\mathbf{44_2}$ . . . $\mathbf{44_i}$ and $\mathbf{46_1}$, $\mathbf{46_2}$ . . . $\mathbf{46_i}$ which when connected by strip conductor circuitry 30 can steer a main beam of the patch-coupled aperture array antenna 100 in one of two different directions depending upon whether feed point 28 or feed point 32 is used. The plurality of RF propagation networks $\mathbf{44_1}$, $\mathbf{44_2}$ . . . $\mathbf{44_i}$ and $\mathbf{46_1}$, $\mathbf{46_2}$ . . . $\mathbf{46_i}$ are provided to control the phase of the RF energy propagating therethrough to steer the main beam. Each one of the plurality of couplers $\mathbf{34_1}$, $\mathbf{34_2}$, $\mathbf{34_3}$ . . . $\mathbf{34_i}$ and 34, $\mathbf{36_1}$, $\mathbf{36_2}$, $\mathbf{36_3}$ . . . $\mathbf{36_i}$ and 36 are disposed to control the amount of coupling provided by each coupler to provide an appropriate amplitude taper by the patch-coupled aperture array antenna 100 which determines the sidelobe levels of the antenna beam (i.e. antenna radiation pattern). The coupler 34, which is typical of each one of the plurality of couplers $\mathbf{34_1}$ . . . $\mathbf{34_i}$ and 34, $\mathbf{36_1}$ . . . $\mathbf{36_i}$ and 36, is a four port device wherein RF energy fed into port **34*a* is coupled to port 34*b* and to port 34*c* with port 34*d* being the isolation port. Similarly, RF energy fed to port 34***d* is coupled to port 34*c* and to port 34*b* with port 34*a* being the isolation port. The plurality of terminating devices $38_1$, $38_2$, $38_3$ . . . $38_i$ and 38, 40 and 42 are disposed to terminate the isolation port of couplers $36_1$, $36_2$, $36_3$ . . . $36_i$ and 36 as described further hereinafter.

As shown in FIG. 2, in the present application, wherein the patch-coupled aperture array antenna 100 is intended to be used on a missile 110, there are two beams steered forward of broadside of the missile wherein the first beam 112 is steered most forward of broadside of the missile and the second beam 114 is steered least forward of broadside of the missile. The feed point 28 provides the first beam 112 and the feed point 32 provides the second beam 114. The feed network 26 provides the requisite amplitude and phase distribution, as well as the required impedance matching for the patch-coupled aperture array antenna 100.

An RF signal fed to feed point 28 is fed to the coupler $34_1$. The coupler $34_1$ is effective to divide an input signal into two output signals wherein one of the output signals is fed to the patch radiator element $10_1$ and the other one of the output signals is fed to the RF propagation network $44_1$. The degree in which the input signal is divided is determined by the desired amplitude distribution of the beam of RF energy of patch-coupled aperture array antenna 100 and is controlled by the spacial distance between the adjacent strip conductors of the coupler $34_1$ and the width of each of the adjacent strip conductors. The RF propagation network $44_1$ provides the necessary phase change to the signal fed thereto and said signal is fed to the coupler $34_2$. The coupler $34_2$ divides an input signal into two output signals wherein one of the output signals is fed to the patch radiator element $10_2$ and the other one of the output signals is fed to the RF propagation network $44_2$. The coupler $34_2$ provides the required degree of coupling to feed an appropriate amount of RF energy to the patch radiator element $10_2$ to produce the necessary amplitude taper with the remaining RF energy being fed to the RF propagation network $44_2$. In a similar manner, RF energy is coupled, via RF propagation network $44_2$, to the coupler $34_3$ and so forth until finally a portion of the RF energy is fed to the patch radiator element 10 and a terminating device 42. With such an arrangement, a first one of the two beams of the patch-coupled aperture array antenna 100 is provided. It should be appreciated that the isolation port of the couplers $34_1$ . . . $34_i$ and 34 are connected to a respective one of the couplers $36_1$ . . . $36_i$ and 36 and senses a matched impedance.

An RF signal fed to feed point 32 is fed to the coupler $36_1$. The coupler $36_1$ is effective to divide an input signal into two output signals wherein one of the output signals is fed to the coupler $34_1$ and the other one of the output signals is fed to the RF propagation network $46_1$. Again, the degree in which the input signal is divided is determined by the desired amplitude distribution of the beam of RF energy of patch-coupled aperture array antenna 100 and is controlled by the spacial distance between the adjacent strip conductors of the coupler $36_1$ and the width of each of the adjacent strip conductors.

The signal fed to the RF propagation network $46_1$ is provided the necessary phase change and is fed to the coupler $36_2$. The coupler $36_2$ divides an input signal into two output signals wherein one of the output signals is fed to the coupler $34_2$ and the other one of the output signals is fed to the RF propagation network $46_2$ The coupler $36_2$ provides the required degree of coupling to each of the output signals to produce the necessary amplitude taper as described hereinbefore. In a similar manner, RF energy is coupled, via RF propagation network $46_2$, to the coupler $36_3$ and so forth until finally a portion of the RF energy is fed to the coupler 36 wherein the RF energy is fed to the coupler 34 and a terminating device 40.

The signal fed to the coupler $34_1$ by the coupler $36_1$ is divided by the coupler $34_1$ into two signals wherein one of the two signals is fed to the patch radiator element $10_1$ and the other one of the two signals (sometimes referred to as a reversed coupled signal) is fed to the coupler $34_2$ via RF propagation network $44_1$. The degree in which the said signal is reversed coupled is determined by the spacial distance between the adjacent strip conductors and the line widths of the strip conductors of the coupler $34_1$ and must be considered when providing the desired amplitude distribution of the beam of RF energy of the patch-coupled aperture array antenna 100. In a like manner, the RF energy fed to the coupler $34_2$ is divided into two signals wherein one of the two signals is fed to the patch radiator element $10_2$ and the other one of the two signals is fed, via propagation network $44_2$, to the coupler $34_3$. It should be appreciated that the RF energy fed to the coupler $34_2$ coming from the coupler $36_2$ adds with the RF energy fed to the coupler $34_2$ coming from the RF propagation network $44_1$. In a like manner, the RF energy fed to the coupler $34_3$ coming from the coupler $36_3$ adds with the RF energy coming from the RF propagation network $44_2$ wherein that total RF energy is divided by the coupler $34_3$ and fed to the patch radiator element $10_3$ and, via the next RF propagation network, to the next coupler. It should now be apparent that the directly coupled and reversed coupled RF energy will continue to propagate within the feed network until finally a portion of the RF energy is fed to the patch radiator element 10 and to the terminating device 42. With such an arrangement, a second one of the two beams of the patch-coupled aperture array antenna 100 is provided. It should be appreciated that the isolation port of the couplers $36_1$ . . . $36_i$ and 36 are connected to a respective one of the terminating devices $38_1$ . . . $38_i$ and 38 and senses a matched impedance.

The patch radiator elements 10 . . . $10_i$ produce little mutual coupling between elements in the H-plane, but experience strong moding being launched into the stripline medium in the E-plane direction. To minimize the moding effect, mode suppression pins $48_1$ . . . $48_i$ are disposed as shown extending from the ground plane 14 to the ground plane 24 along the E-plane. A solid copper rivet is used as a mode suppression pin which provides good electrical contact to the ground planes 14, 24 as well as some temperature gradient relief in a high temperature environment. Here, each one of the mode suppression pins $48_1$ . . . $48_i$ have a diameter of 0,062 inches and a length of 0,187 inches and is separated from an adjacent one by approximately $\lambda/10$. The mode suppression pins $48_1$ . . . $48_i$ also act to reinforce the patch-coupled aperture array antenna 100 as well as provide a more uniform temperature distribution.

The characteristics of the patch radiator element 10 are determined by the dimensions of the patch radiator 18 and the aperture 16 as well as the thickness of the dielectric substrate 12. The patch radiator 18 is dimensioned undersized relative to normal tuned operation while the aperture is dimensioned oversized. The combined effects of the patch radiator 18 with the aperture 16 resulted in improved bandwidth over a standard microstrip patch or aperture. In addition, both the E-plane and H-plane radiator pattern performance was improved resulting in smoother co-polarized patterns and lower levels in cross-polarized patterns.

In the high temperature environment of a missile, it is necessary to use solderless connections to survive the high temperature. In the present embodiment, connections to the strip conductor circuitry 30 is accomplished by $\lambda/4$ overlapping strip conductors making a DC-block style connection instead of a solder connection. The overlapping strip conductors are separated by a thin dielectric layer as described further hereinafter.

Referring now to FIGS. 1 and 3, 3A, 3B and 3C, to provide for a coaxial connection to the feed point 28 and to the feed point 32 of the feed network 26, an RF connector is provided for each feed point as exemplified by connector 50. As described hereinabove, the strip conductor circuitry 30 is disposed between the upper dielectric substrate 12 and the lower dielectric substrate 22. As to be described hereinafter, a bonding layer 52 is used to attached the upper dielectric substrate 12 to the lower dielectric substrate 22. The connector 50 includes a coaxial connector 54 having an outer shield 56 and an inner conductive member 58 with a dielectric material 60 disposed between the outer shield 56 and a portion of the inner conductive member 58. The connector 50 further includes a dielectric substrate 62 having a first and a second surface with an opening 64 extending from the first surface of the dielectric substrate 62 to the second surface of the dielectric substrate 62. The inner conductive member 58 extends through a portion of the opening 64 of the dielectric substrate 62. The connector 50 still further includes a coupling conductive member 66 having a protruding pin 68. The protruding pin 68 is mated with the inner conductive member 58 as shown. To separate the coupling conductive member 66 from the strip conductor circuitry 30, a sheet of dielectric material 70 is disposed juxtapositional with the dielectric substrate 62 to cover the coupling conductive member 66.

A flange 72 extending from the outer shield 56 of the coaxial connector 54 is disposed in a recess provided in the lower dielectric substrate 22. A backing plate 74 is disposed in a recess provided in the upper dielectric substrate 12. Screws, as typified by screw 76, are used to connect the backing plate 74 to the flange 72 to connect the connector 50 to the upper dielectric substrate 12 and the lower dielectric substrate 22. It should be appreciated that the ground plane 14 extends to the backing plate 74 and the ground plane 24 extends to the flange 72 providing electrical continuity between the ground planes 14, 24 and the outer shield 56 of the coaxial connector 54. To facilitate the electrical connection between the ground plane 14 and the backing plate 74, a conductive tape 75 is disposed from the edge of the ground plane 14 to the recessed portion of the dielectric substrate 12 as shown such that when backing plate 74 is assembled, the backing plate rests on a portion of the conductive tape 75. A suitable tape for the conductive tape 75 is an aluminum tape sold as Scotch Brand 433 from 3M Industrial Tape Division of St. Paul, Minn. This aluminum tape comes with an adhesive disposed on one side to adhere the tape as required.

In a similar manner, a conductive tape 73 is disposed from the edge of the ground plane 24 to the recessed portion of the dielectric substrate 22 as shown such that when flange 72 is assembled, the flange 72 rests on a portion of the conductive tape 73. The outer shield 56 with the flange 72 and the backing plate is fabricated from corrosion resistance steel such as alloy three hundred and three. A second flange 80 can also be provided on the outer shield 56 which when combined with a washer 82 and a nut 84 can secure the connector 50 to a supporting structure (not shown).

The protruding pin 68 and the coupling conductor member 66 is fabricated from beryllium copper covered with a nickel plate and further covered with a gold plate to ensure conductive continuity when mated with the inner conductive member 58. The protruding pin 68 is laser welded to the coupling conductor member 66. The coupling conductive member 66 is disposed in a void 78 provided in the dielectric substrate 62 such that the coupling conductive member 66 is flush with the top of the dielectric substrate 62. Furthermore, the dielectric substrate 62 is flush with the lower dielectric substrate 22 when the connector 50 is assembled. The coupling conductive member 66 has a length of $\lambda/4$ of the RF energy propagating therethrough and a width, here, of 0.050 inches. The dielectric substrate 62 is comprised of a Teflon based material known as Taconic TLY-3 manufactured by Taconics Plastics, Inc. located at Petersburg, N.Y. The dielectric substrate 62 has a dielectric constant of 2.33. The sheet of dielectric material 70 disposed over and covering the coupling conductive member 66 is comprised of Kapton having a dielectric constant of 3.5, which prevents DC electrical contact of the coupling conductive member 66 with the strip conductor circuitry 30.

To couple RF energy to the patch-coupled aperture array antenna 100, RF energy is fed to the connector 50 via a coaxial cable (not shown) connected to the coaxial connector 54. The coaxial connector 54 is a SMA female type connector wherein a center conductor (not shown) of the coaxial cable is connected to the inner conductive member 58. RF energy propagates through the coaxial connector 54 and is coupled to the coupling ,conductive member 66 by the protruding pin 68 which mates with the female sleeve provided by the inner conductive member 58. The strip conductor circuitry 30 has an impedance of 100 ohms whereas the coaxial cable has an impedance of 50 ohms. To provide the proper impedance matching, the strip conductor circuitry 30 at the feed point 32 includes a portion 21, a portion **21*a*, a portion 23, a portion 25, a portion 27 and a portion 29. The portion 21, the portion 21*a*, the portion 23 and the portion 27 of the strip conductor 30 have a width of 50 mil and the portion 25 and the portion 29 of the strip conductor 30 have a width of 24 mil. The portion 21, the portion 23 and the portion 27 each have a length of one-quarter of a wavelength. The portion 25 has a length of approximately 0.685 wavelengths. It should be observed that with the introduction of the backing plate 74 and the flange 72 disposed within a portion of the upper dielectric substrate 12 and the lower dielectric substrate 22, respectively, the distance between that portion of the strip conductor circuitry and the effective ground plane is reduced to provide 65 mil stripline instead of 130 mil stripline. As shown, portions 21 and 21*a* are disposed within the 65 mil stripline and portions 23, 25, 27 and 29 are disposed within the 130 mil stripline. With the portion 21 and the portion 21*a* having a width of 50 mils in 65 mil stripline, except for the introduction of the sheet 70 of Kapton, an impedance of 50 ohms would be provided. To provide an impedance match between the 65 mil stripline and the 130 mil stripline, a λ/4 length matching network 33 is provided. The matching network 33 has an impedance of 70.7 ohms which provides a match between the 50 ohm stripline and the 100 ohm stripline with the portion 23 of the strip conductor 30 providing the matching network 33. Following the λ/4 length of the coupling conductive member 66 and the portion 21 of the strip conductor 30 is the portion 21***a* having a length here of approximately 0,075 wavelengths which extends the 65 mil stripline until reaching the edge of the dielectric substrate 62. At the edge of the dielectric substrate 62, the full thickness of the upper dielectric substrate 12 and the lower dielectric substrate 22 is encountered providing 130 mil stripline. With a strip conductor width of 50 mil along portion 23 and disposed in 130 mil stripline, an impedance of 70 ohms is provided to provide the matching network 33. After the matching network 33, at portion 25, the width of the strip conductor is reduced to 24 mil and in 130 mil stripline, an impedance of 100 ohms is provided.

With the sheet 70 of Kapton (having a dielectric constant of 3.5 instead of 2.33) disposed between the strip conductor circuitry and the coupling conductive member 66, the impedance is changed along the one-quarter wavelength length of the coupling conductive member 66 and the portion 21 and the portion 21*a* of the strip conductor 30 from the 50 ohm impedance to a lower value having a frequency dependent component. To correct the effects of the sheet 70 of Kapton, a second matching network 35 is provided by portion 27 of the strip conductor circuitry 30. With a strip conductor width of 50 mil along portion 27 having a length of λ/4 and disposed in 130 mil stripline, an impedance of 70 ohms is provided to provide the matching network 35. After the matching network 35, at portion 29, the width of the strip conductor is reduced to 24 mil and in 130 mil stripline, an impedance of 100 ohms is provided. The portion 27 is disposed adjacent the portion 25 at a location where a real impedance of 50 ohms exist. Such a location would exist here with the portion 29 beginning at a length of 1.25 wavelengths from the beginning of the feed point 32. As such, the 50 ohm impedance is matched to the 100 ohm impedance by the matching network 35. It should be noted that a change in the thickness of the bonding layer 52 at the feed point 32 will change the impedance some what. The matching network 35 ensures a proper match even if the bonding layer 52 should vary during the manufacturing process.

It should be appreciated that RF energy which is fed to the coupling conductive member 66 is coupled to the strip conductor circuitry 30 in the same manner RF energy is coupled in a DC block as taught on pages 279–281 in the textbook "Microwave Engineering Passive Circuits" by Peter A. Rizzi, published by Prentice Hall, Englewood Cliffs, N.J. 07632 in 1988. The RF energy is then coupled through the matching networks 33 and 35 to the patch-coupled aperture array antenna 100.

The connector 50 is assembled by placing the opening 64 of the dielectric substrate 62 about the inner conductive member 58 of the coaxial connector 54 and then disposing the coupling conductive member 66 in the void 78 of the dielectric substrate 62 with the protruding pin 68 mating with the inner conductive member 58. The sheet 70 of Kapton is placed over the coupling conductive member 66 to cover the coupling conductive member 66 and the dielectric substrate 62. The coaxial connector 54 with the dielectric substrate 62, the coupling conductive member 66 and the sheet 70 of Kapton is placed in the recess of the lower dielectric substrate 22 and with the back plate 74 disposed in the recess of the upper dielectric substrate 12, screws, as typified by screw 76, are used to attach the connector 50 to the patch-coupled aperture array antenna 100.

Having described the construction and operation of connector 50 for coupling RF energy to feed point 32, the construction and operation of a connector 51 for coupling RF energy to feed point 28 is similar. The connector 50 and the connector 51 are hermetically sealed to an inner cable assembly to protect the connectors 50, 51 and the inner cable assembly from the environment.

Figure 4:
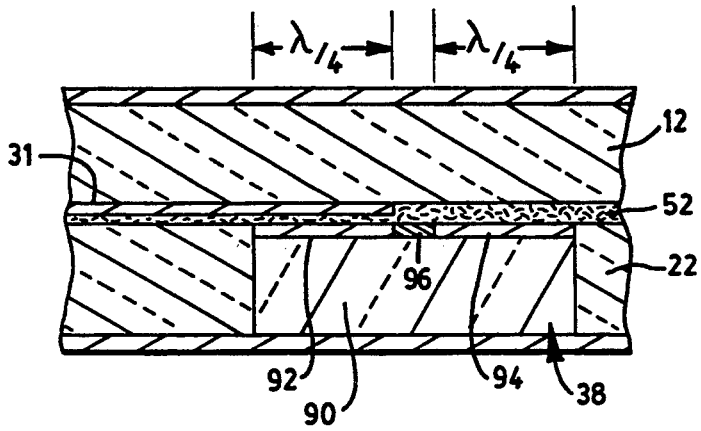
FIG. 4 is a cross-sectional view of a terminating device for the patch-coupled aperture array antenna according to the invention.
Figure 4A:
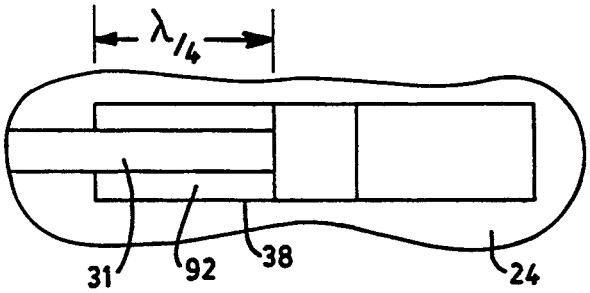
FIG. 4A is a plan view of a portion of strip conductor disposed above the terminating device according to the invention.

Referring now to FIGS. 1, 4 and 4A, the terminating device 38, which is typical of the plurality of terminating devices $38_1$, $38_2$, $38_3$ . . . $38_i$ and 38, 40 and 42, includes a dielectric substrate 90, here comprising alumina having a dielectric constant of 9.1. On a top surface of the dielectric substrate 90 is a strip conductor 92 and a strip conductor 94, the strip conductors 92 and 94 fabricated from brazed silver. The strip conductor 92 and the strip conductor 94 are each a λ/4 in length and a width of 25 mils. Disposed in between the strip conductor 92 and the strip conductor 94 and connected thereto is a resistive element 96 of a metal glaze to provide the necessary resistance value. Here the resistance value is 50 ohms. The terminating device 38 is placed in a cavity 88 disposed in the lower dielectric substrate 22. The cavity 88 is dimensioned to accommodate the terminating device 38. A strip conductor 31, being a portion of the strip conductor circuitry 30, is disposed above the strip conductor 92 separated by the bonding layer 52.

The terminating device 38 provides a matched impedance to the isolation port of coupler 36. That portion of the strip conductor 31 disposed before the terminating device 38 has an impedance of 100 ohms which is the impedance of the coupler 36. In the region of the terminating device 38, the upper dielectric substrate 12 having a dielectric constant of 2.3 and the dielectric substrate 90 having a dielectric constant of 9.1 provides an effective dielectric constant of 5.04. As such, the strip conductor 31 above the terminating device 38 and the strip conductor 92 have an impedance of approximately 70 ohms and the λ/4 length coupling portion provided by the strip conductor 31 disposed above the strip conductor 92 of the terminating device 38 acts as a transformer to match the 50 ohm impedance of the resistive element 96 to the 100 ohm impedance of the strip conductor circuitry 30. That portion of the strip conductor 31 disposed juxtapositional with the strip conductor 92 with the bond layer 52 in between operates in a manner as a DC block and RF energy which is fed to the strip conductor 31 is coupled to the strip conductor 92 in the same manner RF energy is coupled in a DC block. The λ/4 length of strip conductor 94 provides a one-quarter wavelength virtual RF short to ground for the resistive element 96.

It should now be appreciated that, wherein the strip conductor 31 before the terminating device 38 has a 100 ohm impedance, the resistive element 96 has a 50 ohm impedance and the upper dielectric substrate 12 in combination with the dielectric substrate 90 during the portion of strip conductor 31 overlapping the strip conductor 92 provides a 70 ohm impedance to provide an impedance transformer, a properly matched circuit is provided.

The terminating device 38 is disposed in the cavity 88 during construction of the patch-coupled aperture array antenna 100 and with the upper dielectric substrate 12 secured to the lower dielectric substrate 22 by the bonding layer 52, the terminating device is secured in place. With such an arrangement, the plurality of terminating devices $38_1$, $38_2$, $38_3$ . . . $38_i$ and 38, 40 and 42 are provided which can survive the high temperature environment of a missile, but require less manufacturing steps than other known techniques.

To connect the upper dielectric substrate 12 with the lower dielectric substrate 22, a bonding layer 52 is used. The bonding layer 52 is comprised of a modified PTFE (polytetrafluoroethylene) bond film known as Fluorolin 200 (Part No. 354-2) provided by DeWal Industries of Sauderstown, R.I. The modified PTFE bond film has all the bulk properties of standard PTFE bond film, but can be bonded at temperatures as low as 625 degrees Fahrenheit rather than the conventional temperature of 710 degrees Fahrenheit for standard PTFE bond film. The process is to fusion bond the upper dielectric substrate 12 to the lower dielectric substrate 22 using the bonding layer 52, here having a thickness of 0.005 inches, at a temperature of 650 degrees Fahrenheit to 675 degrees Fahrenheit and to maintain the bonding layer 52 at the latter temperature for a minimum of 15 minutes and at a pressure of 80 psi (±20 psi). It is necessary to maintain the bonding layer temperature no less than 650 degrees Fahrenheit throughout the 15 minute bond period. The upper dielectric substrate 12 and the lower dielectric substrate 22 should be cleaned, degreased and tetra-etched prior to the bonding step. It is recommended that the tetra-etching be performed no more than 12 hours prior to the bonding step, with the upper dielectric substrate 12 and the lower dielectric substrate 22 stored in a nitrogen purged, ultraviolet protected, sealed bag during the period between tetra-etching and bonding. It should be appreciated that if the temperature of the bonding process is increased beyond the recommended limits, an effect known as circuit swimming will take place wherein the strip conductor circuitry 30 and the patch radiator elements 18 . . . $18_i$ may move relative to one another.

During flight of a missile, the environment external to the patch-coupled aperture array antenna 100 may experience temperatures in excess of 820 degrees Fahrenheit. With such a temperature external to the patch-coupled aperture array antenna 100, at the bonding layer 52 the temperature may reach a temperature of 620 degrees Fahrenheit. Thus, the bonding layer 52 must be able to survive a temperature of 620 degrees Fahrenheit. With the mode suppression pins $48_1$ . . . $48_i$ connected between the ground plane 14 and the ground plane 24, a more uniform temperature gradient is provided under such extreme temperature conditions.

The patch-coupled aperture array antenna 100 may also include tape (not shown), such as that used for tape 75, around the edges of the antenna to connect the top ground plane 14 to the bottom ground plane 24. Furthermore, tape (not shown) can be used to bond the top ground plane 14 to the shell of the missile 110 (FIG. 2) to enhance the effect of the ground plane.

Figure 6:
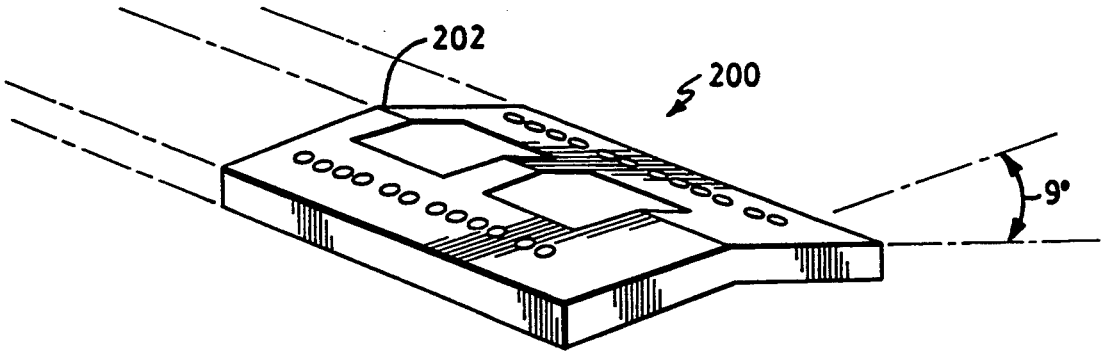
FIG. 6 is an isometric view of an alternative embodiment of an patch-coupled aperture array antenna.

Referring now to FIG. 6, a patch-coupled aperture array antenna 200 is shown wherein the patch-coupled aperture array antenna 200 is similar to the patch-coupled aperture array antenna 100 of FIG. 1, but the longitudinal center of the patch-coupled aperture array antenna 200 is bent at a bend line 202 at an angle of nine degrees. The angle of nine degrees was provided such that the patch-coupled aperture array antenna 200 could be mounted along the sides of a missile having a smaller radius than that which would be allowed by the patch-coupled aperture array antenna 100 of FIG. 1. This bent configuration did have effects on the circuitry and radiators. More specifically, the phase lengths of the circuit runs across the bend were reduced by approximately two degrees, but had minimal effect on performance. The patch radiator 18 and the aperture 16 were also slightly shortened by being bent and were redimensioned to compensate for the bend such that the dimensions with the bend were as described with the patch-coupled aperture array antenna 100. Furthermore, the center line of the patch radiator elements 10 . . . $10_i$ could not be physically positioned at the bend line 202 and therefore created an asymmetry in the patch-coupled aperture array antenna 200. The latter was due to the difference between the lengths of the RF propagation networks 44 . . . $44_i$ and the lengths of the RF propagation networks 46 . . . $46_i$. This asymmetry primarily effected the linear cross-polarization in the radiation patterns by elevating the levels somewhat, but were within tolerances. The above described bonding process worked effectively for this configuration. With such an arrangement, a patch-coupled aperture array antenna 200 is provided adapted to operate in a high temperature environment of a missile.

Having described this invention, it will now be apparent to one of skill in the art that the number and disposition of the patch radiator elements may be changed without affecting this invention. It is felt, therefore, that this invention should not be restricted to its disclose embodiment, but rather should be limited only by the spirit and scope of the appended claims.

What is claimed is:

1. A radio frequency connector comprising:

(a) a coaxial connector having an outer shield and an inner conductive member having an end with a dielectric material disposed between the outer shield and a portion of the inner conductive member;

(b) a dielectric substrate having a-first and a second surface with an opening extending from the first surface of the dielectric substrate to the second surface of the dielectric substrate, the inner conductive member extending through at least a portion of the opening of the dielectric substrate;

(c) a coupling conductive member having a protruding pin, the protruding pin connected to the end of the inner conductive member;

(d) a sheet of dielectric material having opposing surfaces, the sheet of dielectric material disposed juxtapositional with the dielectric substrate and covering the coupling conductive member;

(e) a second dielectric substrate having a first and second surface with a strip conductor disposed on the first surface of the second dielectric substrate, the coupling conductive member and a portion of the strip conductor disposed adjacent to respective opposing surfaces of the sheet of dielectric material;

(f) means for impedance matching the coaxial connector with the strip conductor disposed on the first surface of the second dielectric substrate;

(g) a flange extending from the outer shield of the coaxial connector;

(h) a backing plate; and (i) at least one screw extending from the backing plate to the flange.

2. The radio frequency connector as recited in claim 1 wherein the impedance matching means comprises:

(a) a first portion of strip conductor having a first width, the first portion including the portion of strip conductor disposed adjacent to the sheet of dielectric material;

(b) a second portion of strip conductor having a second different width, the second portion connecting to the first portion;

(c) a third portion of strip conductor having the first width, the third portion connecting to the second portion; and (d) a fourth portion of strip conductor having the second different width, the fourth portion connecting to the third portion.

3. The radio frequency connector as recited in claim 1 wherein the dielectric substrate is provided from a Teflon based material.

4. The radio frequency connector as recited in claim 1 wherein the coupling conductive member having a protruding pin is fabricated from beryllium copper.

5. The radio frequency connector as recited in claim 1 wherein the sheet of dielectric material is provided by Kapton tape.

6. The radio frequency connector as recited in claim 1 wherein the outer shield, the flange and the backing plate are provided from a corrosion resistant steel.

7. A radio frequency connector comprising:

(a) means for connecting a coaxial cable, said connecting means comprising an outer shield and an inner conductive member having an end with a dielectric material disposed between the outer shield and a portion of the inner conductive member; and (b) means for coupling radio frequency energy from the inner conductive member to an end of strip conductor circuitry comprising:

(i) a dielectric substrate having a first and a second surface with an opening extending from the first surface of the dielectric substrate to the second surface of the dielectric substrate, the inner conductive member extending through at least a portion of the opening of the dielectric substrate;

(ii) a coupling conductive member having a protruding pin, the protruding pin connected to the end of the inner conductive member;

(iii) a sheet of dielectric material having opposing surfaces, the sheet of dielectric material disposed juxtapositional with the dielectric substrate and the coupling conductive member;

(iv) a second dielectric substrate having a first and second surface with a strip conductor disposed on the first surface of the second dielectric substrate, the coupling conductive member and a portion of the strip conductor circuitry disposed adjacent to respective opposing surfaces of the sheet of dielectric material; and (v) means for impedance matching the coaxial cable with the strip conductor circuitry comprising:

a first portion of strip conductor having a first end and a second end, the first end disposed juxtapositional with the sheet of dielectric material and the first portion of strip conductor including the portion of the strip conductor circuitry;

a second portion of strip conductor disposed adjacent the second end of the first portion, the second portion having a length of one-quarter wavelength of the radio frequency energy propagating therethrough; and a third portion of strip conductor disposed adjacent the second portion; the third portion having an impedance equal to the impedance of the strip conductor circuitry, the second portion of strip conductor having a width different than the third portion of strip conductor.

8. A radio frequency transducer comprising:

(a) a first and a second dielectric substrate, each dielectric substrate having a first and second surface;

(b) a first and a second sheet of conductive material, the first sheet of conductive material disposed on the first surface of the first dielectric substrate and the second sheet of conductive material disposed on the first surface of the second dielectric substrate, the second surface of the first dielectric facing the second surface of the second dielectric;

(c) strip conductor circuitry disposed between the second surface of the first dielectric substrate and the second surface of the second dielectric substrate;

(d) a coaxial connector having an outer shield and an inner conductive member with a dielectric material disposed between the outer shield and a portion of the inner conductive member;

(e) a dielectric substrate having a first and a second surface with an opening extending from the first surface of the dielectric substrate to the second surface of the dielectric substrate, the inner conductive member extending through at least a portion of the opening of the dielectric substrate;

(f) a strip of strip conductor having a protruding pin, the strip of strip conductor disposed facing a portion of the strip conductor circuitry and the protruding pin mating with the inner conductive member;

(g) a sheet of dielectric material disposed between the portion of the strip conductor circuitry and the strip of strip conductor; and the strip conductor circuitry comprising:

(i) a first portion of strip conductor having a first width, the first portion including the portion of strip conductor disposed facing the strip of strip conductor;

(ii) a second portion of strip conductor having a second different width, the second portion connecting to the first portion;

(iii) a third portion of strip conductor having the first width, the third portion connecting to the second portion; and (iv) a fourth portion of strip conductor having the second different width, the fourth portion connecting to the third portion.

9. The radio frequency transducer as recited in claim 8 further comprising a bonding layer disposed between the first dielectric substrate and the second dielectric substrate, the bonding layer capable of withstanding a temperature greater than 500 degrees Fahrenheit.

10. The radio frequency transducer as recited in claim 9 wherein the first portion and the second portion of strip conductor together have a length to provide a 50 ohm impedance at an end thereof.

11. The radio frequency transducer as recited in claim 10 wherein the third portion of strip conductor has a length of one quarter wavelength of radio frequency energy propagating therethrough.

* * * * *